US011094303B2

(12) United States Patent
Black

(10) Patent No.: US 11,094,303 B2
(45) Date of Patent: Aug. 17, 2021

(54) SUPER STRAP BUTTON

(71) Applicant: Sterling Black, Brunswick, ME (US)

(72) Inventor: Sterling Black, Brunswick, ME (US)

(73) Assignee: Sterling Black, Portland, ME (US)

( * ) Notice: Subject to any disclaimer, the term of this patent is extended or adjusted under 35 U.S.C. 154(b) by 0 days.

(21) Appl. No.: 16/911,260

(22) Filed: Jun. 24, 2020

(65) Prior Publication Data

US 2020/0402486 A1 Dec. 24, 2020

Related U.S. Application Data

(60) Provisional application No. 62/865,541, filed on Jun. 24, 2019.

(51) Int. Cl.
*G10G 5/00* (2006.01)
*A44B 17/00* (2006.01)

(52) U.S. Cl.
CPC ..... *G10G 5/005* (2013.01); *A44B 17/0052* (2013.01)

(58) Field of Classification Search
CPC ..... G10G 5/005
See application file for complete search history.

(56) References Cited

U.S. PATENT DOCUMENTS

| | | | | |
|---|---|---|---|---|
| 3,894,464 | A | 7/1975 | Brooks | |
| 4,188,851 | A | 2/1980 | Wolf | |
| D293,687 | S | 1/1988 | Nichols | |
| 7,045,694 | B2 | 5/2006 | Yasunori | |
| 7,166,789 | B2 | 1/2007 | Warden | |
| 7,718,875 | B2 * | 5/2010 | Shereda | G10D 1/085 84/327 |
| 8,269,085 | B1 * | 9/2012 | Darbon | G10G 5/005 84/327 |
| 8,710,341 | B2 * | 4/2014 | Bowen | G10G 5/005 84/327 |
| 9,082,374 | B2 * | 7/2015 | Aires | G10D 1/085 |
| 10,750,830 | B1 * | 8/2020 | Blekherman | A41F 1/02 |
| 2005/0045021 | A1 * | 3/2005 | Berger | G10G 5/005 84/327 |
| 2006/0054002 | A1 | 3/2006 | Tambara | |

(Continued)

FOREIGN PATENT DOCUMENTS

GB 2531574 A * 4/2016 ..... G10D 1/08

OTHER PUBLICATIONS

"2X Jumbo Strap Pins", Axesrus.co.uk. Discoverable online as early as 2015. 2 pages. (https://www.axesrus.co.uk/Jumbo-Strap-Pins-Chorme-p/he014.htm).

(Continued)

*Primary Examiner* — Robert W Horn
(74) *Attorney, Agent, or Firm* — Wilmer Cutler Pickering Hale and Dorr LLP

(57) ABSTRACT

A strap button for attaching a supporting strap to a musical instrument is disclosed. The strap button includes an inner flange, a lug, a retaining flange, and an outer flange, with the inner flange configured to directly or indirectly contact the musical instrument. The lug is adjacent to the inner flange on one end, and the retaining flange and the outer flange on the other end. The lug is configured to support a hole of a supporting strap between the outer flange and the musical instrument. The retaining flange serves as a barrier to the supporting strap from slipping off the lug.

16 Claims, 22 Drawing Sheets

(56) References Cited

U.S. PATENT DOCUMENTS

| | | | | |
|---|---|---|---|---|
| 2012/0260475 | A1* | 10/2012 | D'Addario | G10G 5/005 24/701 |
| 2012/0279375 | A1* | 11/2012 | Page | G10G 5/005 84/327 |
| 2020/0402486 | A1* | 12/2020 | Black | A44B 17/0052 |

OTHER PUBLICATIONS

"Diago Twistlock Strap Button", Best Bass Gear, available online Jan. 25, 2016. 6 pages. (https://www.bestbassgear.com/diago-twistlock.htm).

"Disens Guitar Strap Buttons Locks Quick Release Straplocks Strap Retainer Pegs Guitar Replacement Parts", Amazon.com, first available Feb. 19, 2019. 6 pages. (https://www.amazon.com/DISENS-Straplocks-Retainer-Replacement-Accessories/dp/B07NWGX1FC?th=1).

"Dunlop SLS1401N Straplok Flush Mount Strap Retainer System", Amazon.com, first available Jan. 29, 2006. 8 pages. (https://www.amazon.com/Dunlop-SLS1401N-Straplok-Retainer-System/dp/B000EEHFJG?th=1.).

"Gripper Strap Buttons", StewMac.com, available online Jun. 27, 2014. 3 pages. (https://www.stewmac.com/parts-and-hardware/strap-buttons/gripper-strap-buttons-set-of-2.html).

"Hardware & Electronics: Body Parts", Frets on the Net, available online Aug. 22, 2013. 5 pages. (https://web.archive.org/web/20130822041650/https:/www.fretsonthenet.com/Hardware_Electronics/body%20parts.htm).

"Large Strap Buttons", Nextgenguitars.com. Discoverable online as early as 2016. 3 pages. (https://nextgenguitars.ca/products/large-strap-buttons-black-pair.html).

"Lindo Gold Guitar Strap Button", Lindo.com. 3 pages. (https://lindoguitars.com/product/lindo-gold-guitar-strap-button/).

"Strap Button, Gold, Oversize", eBay.com, last updated on Nov. 8, 2017. 3 pages. (https://www.ebay.com/itm/Strap-Button-Gold-Oversize-with-engraved-Rose/201771430168?hash=item2efa83b118:g:1CkAAOSwDk5Tx~F5:sc:USPSFirstClass!04330!US!-1:rk:17:pf:0).

* cited by examiner

SUPER STRAP BUTTON

CROSS-REFERENCE TO RELATED APPLICATIONS

This application claims the benefit of priority to U.S. Provisional Application No. 62/865,541, entitled "Super Strap Button," filed on Jun. 24, 2019, the disclosure of which is hereby incorporated by reference in its entirety.

FIELD OF DISCLOSURE

The present invention relates generally to musical instruments, and specifically to strap buttons that secure a strap to an instrument. Although a guitar is used as an example, it is to be understood that users may also install this button on other portable musical instruments such as basses, keyboards, ukuleles, banjos, drums, and others.

BACKGROUND

Musical instruments, such as a guitar, are often carried and played while standing upright, requiring a supporting strap. This strap (made of leather, fabric, or other material) hangs from the user's shoulder and is attached to the musical instrument by holes in ends of the supporting strap that fit over strap buttons. Strap buttons (also known as lugs or end pins) are usually attached to the musical instrument by a screw along with a felt or rubber washer to protect the instrument. Supporting straps and strap buttons allow users to carry their musical instruments and better control them whilst performing live, in the studio, or at home. A common issue among musicians who use straps is that their supporting strap slips from its button while being played or carried, resulting in the instrument being dropped and damaged, and which can even result in injury to the player or observer. Thus, an object of embodiments of this disclosure is to provide a strap button with increased security, for example, by use of a large outer flange that holds the supporting strap in place, preventing slippage and subsequent damage to the instrument or harm to the user.

SUMMARY

Embodiments of the disclosure relate to a strap button improvement incorporating a large outer flange to secure the carrying strap in place and prevent common strap slippage, or failure from occurring.

According to some embodiments, a strap button includes an inner flange having a contact surface configured to directly or indirectly contact the instrument. The strap button also has a lug extending from the inner flange in a direction opposite the contact surface of the inner flange. The lug defines an axis of the strap button along the direction opposite the contact surface with the inner flange toward a proximal end of the axis of the strap button. The lug has a lug width defined by a largest width of the lug in the direction perpendicular to the axis of the strap button. The inner flange has an inner flange width defined by a largest width of the inner flange in the direction perpendicular to the axis of the strap button. The strap button also has an outer flange toward a distal end of the axis of the strap button. The outer flange has an outer flange width defined by a largest width of the outer flange in a direction perpendicular to the axis of the strap button. The strap button further has a retaining flange adjacent the outer flange along the axis of the strap button toward the inner flange. The retaining flange has a retaining flange width defined by a largest width of the retaining flange in a direction perpendicular to the axis of the strap button. The lug width is smaller than the inner flange width, the retaining flange width, and the outer flange width. The retaining flange width is 18%-50% of the outer flange width and the inner flange width is 18%-50% of the outer flange width. The lug is configured to support a hole of a supporting strap between the outer flange and the instrument.

In some embodiments, the retaining flange is configured as a barrier to the supporting strap from slipping off the lug.

In certain embodiments, the retaining flange and the outer flange are configured as a first barrier and a second barrier, respectively, to the supporting strap from slipping off the lug.

In certain embodiments, the lug width is 36%-99% of the retaining flange width.

In certain embodiments, the retaining flange width is between 8-22 mm.

In certain embodiments, at least one of the inner flange, the outer flange, the retaining flange, or the lug has a circular cross section along the axis of the strap button.

In certain embodiments, at least one of the inner flange, the outer flange, the retaining flange, or the lug has a hexagonal cross section along the axis of the strap button.

In certain embodiments, at least one of the inner flange, the outer flange, the retaining flange, or the lug has a rectangular cross section along the axis of the strap button.

In certain embodiments, the inner flange, the outer flange, the lug and the retaining flange are integrally formed.

In certain embodiments, the outer flange and the retaining flange are integrally formed.

In certain embodiments, the retaining flange is configured to add mechanical strength to the strap button.

In certain embodiments, the strap button has a strap button height defined as a length of the strap button along the axis of the strap button, wherein the strap button height is between 4-22 mm.

In certain embodiments, the strap button height is 9%-50% of the outer flange width.

In certain embodiments, the lug includes an inner lug that is defined as an interior surface of the lug extending in a direction along the axis. The inner lug has an inner lug width defined by a largest width of the inner lug in the direction perpendicular to the axis of the strap button, wherein the lug width is between 3 mm and 4 mm larger than the inner lug width.

In certain embodiments, the inner lug width is 27%-78% of the lug width.

In certain embodiments, the strap button further includes one or more auxiliary flanges between the outer flange and the retaining flange along the axis of the strap button, wherein the one or more auxiliary flanges are configured as a barrier to the supporting strap from slipping off the lug.

DETAILED DESCRIPTION OF THE INVENTION

Figure 1:
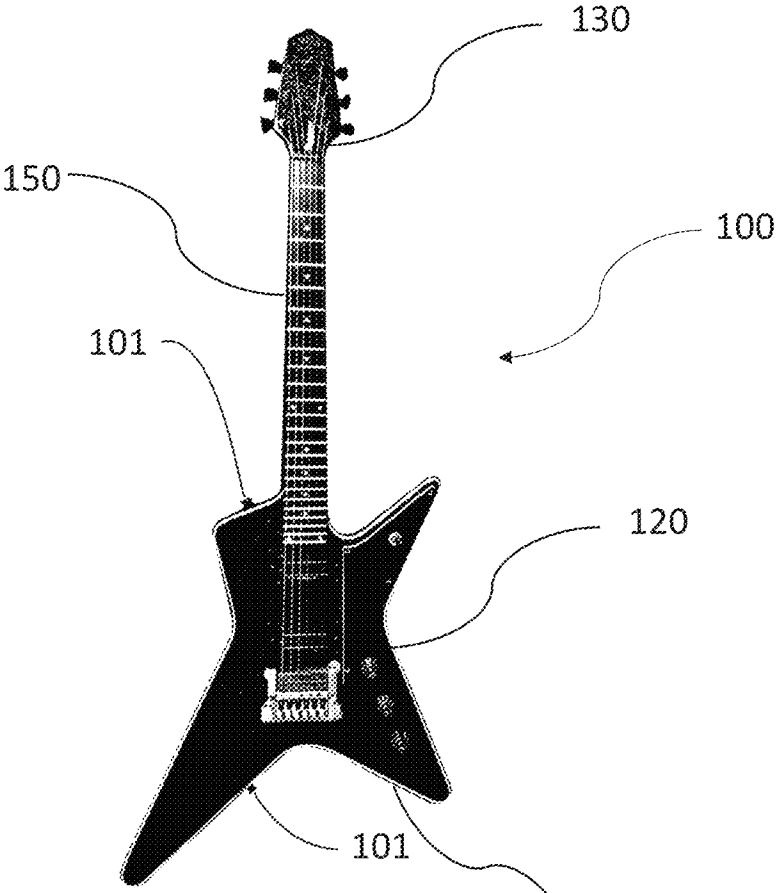
FIG. 1 is an illustration of an electric guitar with strap buttons.

The present invention will be described herein with reference to the attached figures. It should be understood that although specific embodiments are demonstrated in the drawings and described herein, variations of these embodiments are within the scope of the present invention. Variations of materials, sizes, shapes, or any other components of the object or method described herein may be varied and still be encompassed by the scope of the claims herein. Although a guitar is used as the example for this invention, it is to be understood that musicians may also install and use this button on other portable musical instruments and devices. For convenience, the strap button is generally described in relation to its use with a guitar. It should be understood that the strap button described in embodiments below may also be used on any instruments requiring a support strap, such as basses, keyboards, ukuleles, banjos, drums, and others.

FIG. 1 shows a guitar 100, such as an electric guitar. The guitar has strap buttons (also known as lugs or end pins) 101. In certain embodiments, the strap buttons 101 are affixed to the guitar 100 by means of a screw, adhesive, or other means suitable for the weight or size of the instrument. The strap buttons 101 may be placed in a variety of locations on the guitar 100, such as on body 120, or headstock 130, which can be made of wood, acrylic, or other material. For example, the strap buttons in FIG. 1 are shown at the butt 140 of the body 120 of the guitar 100, and near where the neck 150 meets the body 120. In certain embodiments, the strap buttons are affixed to side edges of the body 120 of the guitar 100 as shown in FIG. 1, but can also be provided on the back or front of the body 120 of the guitar 100, according to certain embodiments. In certain embodiments, strap buttons may also be attached to the headstock 130 of the guitar. In certain embodiments, two or more strap buttons are used, and in other embodiments only one strap button is used.

Figure 2:
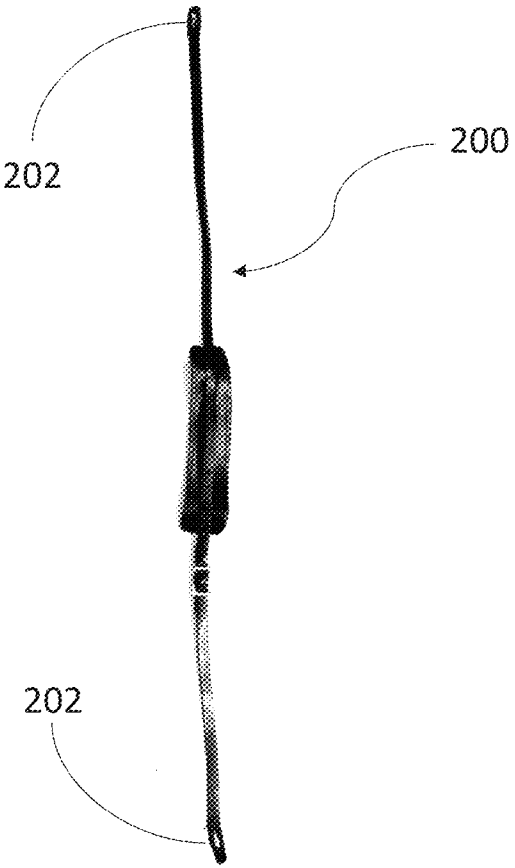
FIG. 2 is an illustration of an electric guitar supporting strap.
Figure 3:
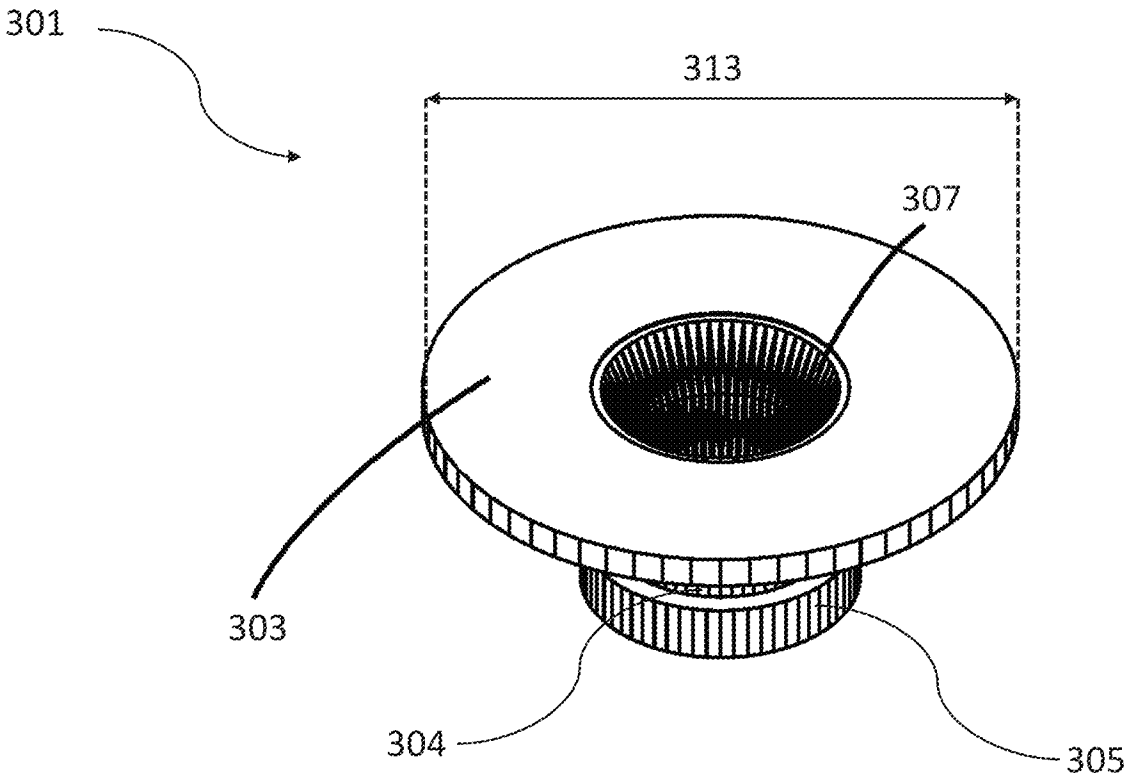
FIG. 3 is an illustration of an isometric top view of a strap button with a flange according to a first embodiment.
Figure 4:
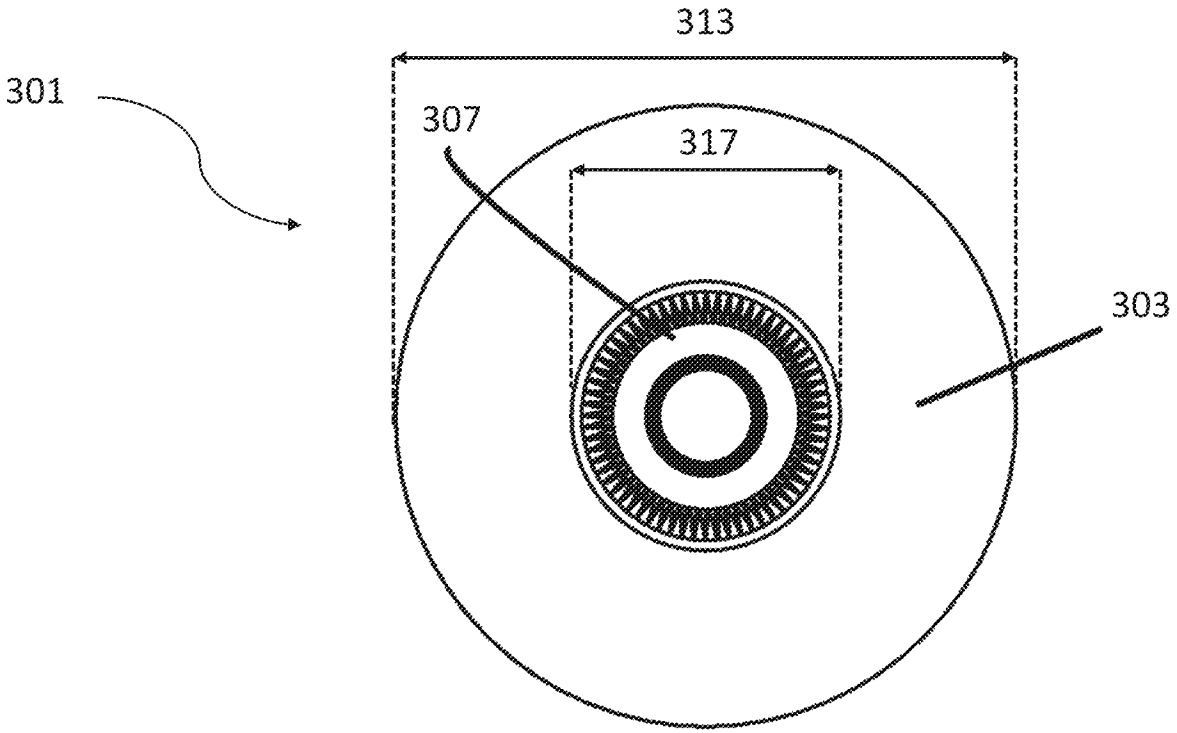
FIG. 4 is an illustration of a top view of a strap button of the first embodiment.

The strap buttons 101 correspond to holes 202 at the ends of supporting strap 200, shown in FIG. 2. The strap 200 can be an elongated piece of leather, fabric, or other material that fits around the body of the user in order to hold the instrument. In operation, the strap buttons 101 fit within the holes 202 of the strap 200 so that the strap 200 is anchored by the strap buttons 101, thereby allowing the weight of the guitar to be supported by the strap 200. In certain embodiments, the strap 200 has multiple holes 202 or adjusting features corresponding to multiple lengths of the strap 200. In certain embodiments, the strap 200 has at least one hole 202 at each end of the strap 200. In certain embodiments, the strap may have a hole 202 only on one end/side of the strap 200. In certain embodiments, supporting strap 200 has a tying end at the end opposite the end having a hole 202 so that the tying end may be tied, for example, to where the neck 150 of the guitar meets the headstock 130. Fitment or positioning of holes of the strap on the strap button according to certain embodiments is discussed in further detail below with respect to FIG. 22.

As discussed above, strap buttons 101 may suffer a problem in that a strap 200 can become dislodged from the strap buttons 101 during use, causing the guitar to fall. This can result in damage to the guitar or injury to the user or an observer. It also causes disruption during performance. Therefore, an aspect of embodiments of this disclosure is to prevent the strap 200 from becoming dislodged from the strap buttons 101 by altering the geometry of the strap button. For example, it is possible for straps 200 to become dislodged because the strap button 101 is not large enough to retain the strap holes 202. According to certain embodiments, an outer flange or retaining flange of the strap button 101 has a larger diameter, for example than traditional strap buttons, to better secure the strap 200 to the guitar 100 by preventing the strap 200 from becoming dislodged.

Figure 20:
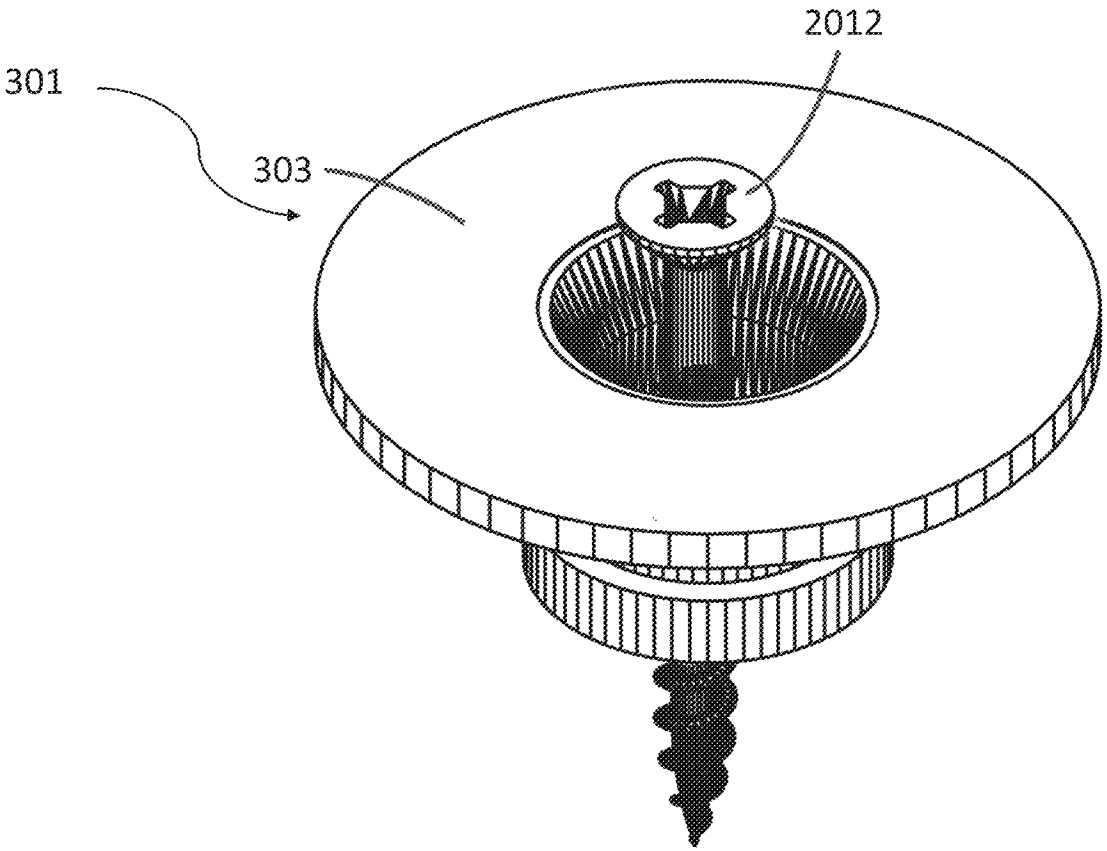
FIG. 20 demonstrates an isometric view of a screw passing through a strap button, according to certain embodiments.
Figure 21:
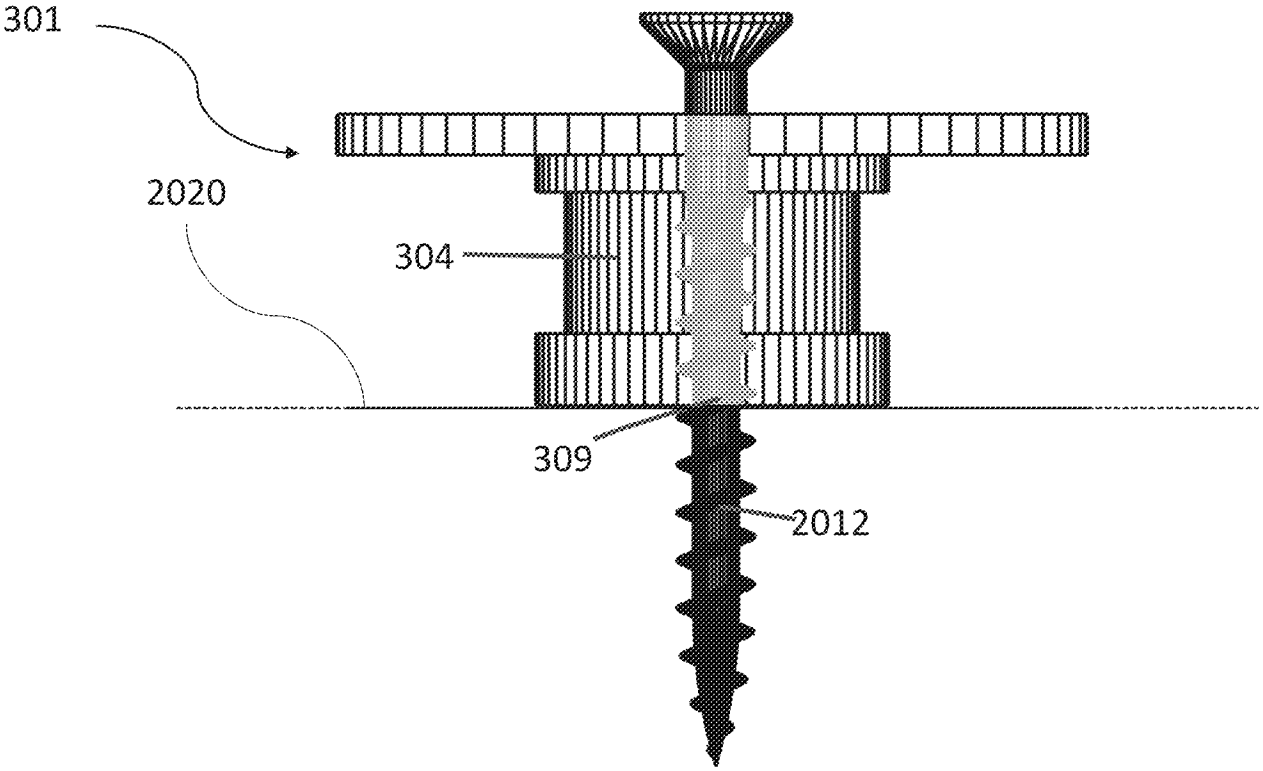
FIG. 21 demonstrates a cross section side view of a screw passing through a strap button, according to certain embodiments.

FIGS. 3-7 show a strap button according to a first embodiment of the disclosure. The strap button 301 has outer flange 303, lug 304, inner lug 307, retaining flange 308, inner flange 305, and bore 309. Inner lug 307 is defined by the interior surface of lug 304. In certain embodiments, a screw or other fixing device passes through the inner lug 307, for example as shown in FIGS. 20-21, discussed below. In certain embodiments, the strap button 301 including outer flange 303, lug 304, and inner flange 305, and retaining flange 308, is integrally formed of one piece. Forming the strap button 301 of one piece provides a number of benefits, including that it reduces the complexity of use and manufacture of the strap button 301, and reduces the likelihood that a user will lose one part of the strap button rendering the strap button 301 inoperable. Integrally forming strap button 301 may also result in a stronger product that is less prone to breakage or failure. These benefits improve over, for example, strap locks, such as disclosed in U.S. Pat. No. 7,256,337 B1, issued Aug. 14, 2007. In other embodiments, the strap button is formed of multiple parts. For example, one or more of the outer flange, the retaining flange, the lug, and the inner flange can be formed of different parts and attached together before or after attaching to an instrument. The strap button 301 may be attached to the guitar 100 by screw, for example as discussed below with respect to FIGS. 20-21, according to certain embodiments. In certain embodiments, the strap button 301 does not contain one or both of the inner flange 305 and retaining flange 308.

Figure 22:
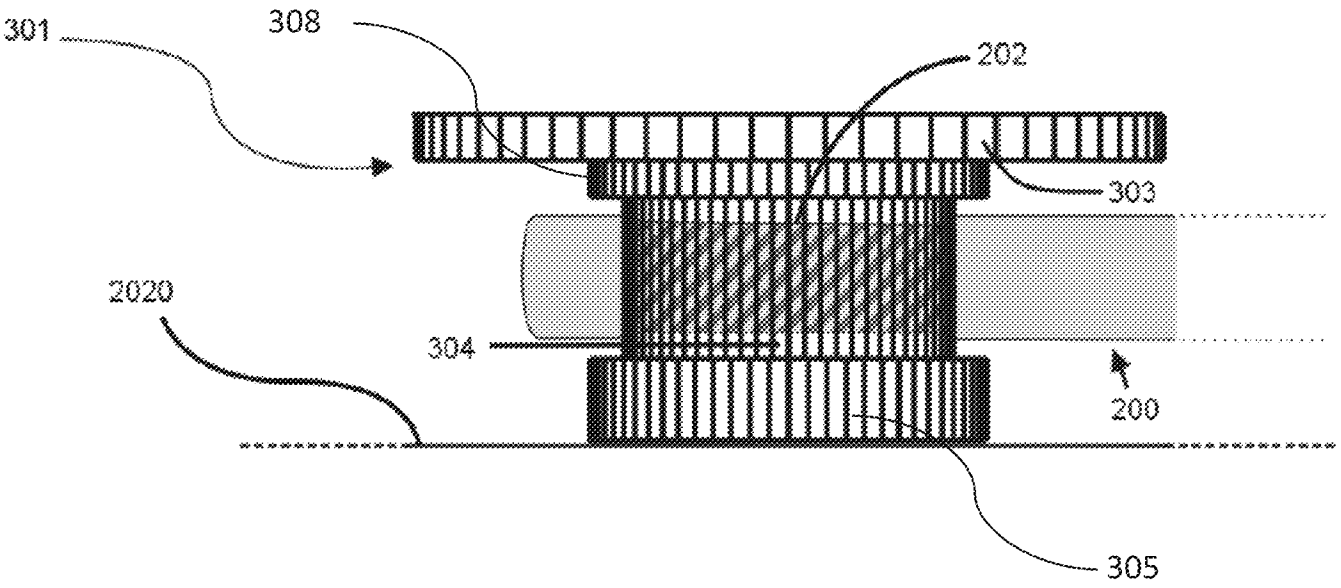
FIG. 22 shows a side view of a strap secured to a strap button.

In use, the strap button 301 is attached to an instrument such as guitar 100 with the inner flange 305 abutting the instrument and the outer flange 303 opposite the inner flange 305. In operation, the holes 202 of strap 200 generally sit on lug 304 between inner flange 305 and retaining flange 308, for example as shown in FIG. 22. Retaining flange 308 provides an initial or first barrier to prevent strap 200 from slipping off strap button 301. The larger outer flange 303 provides an additional or second barrier to prevent strap 200 from slipping off strap button 301. In addition, inner flange 305 increases the surface area in contact with, for example, the body 120 of the guitar 100. This reduces the likelihood that the strap button 301 will cause damage to the body 120 of the guitar 100 because it spreads forces applied to the strap button 301 from the strap 200 across a larger area of the body 120. The increased area in contact with body 120 also makes the strap button 301 less likely to become dislodged from the guitar 100.

Figure 5:
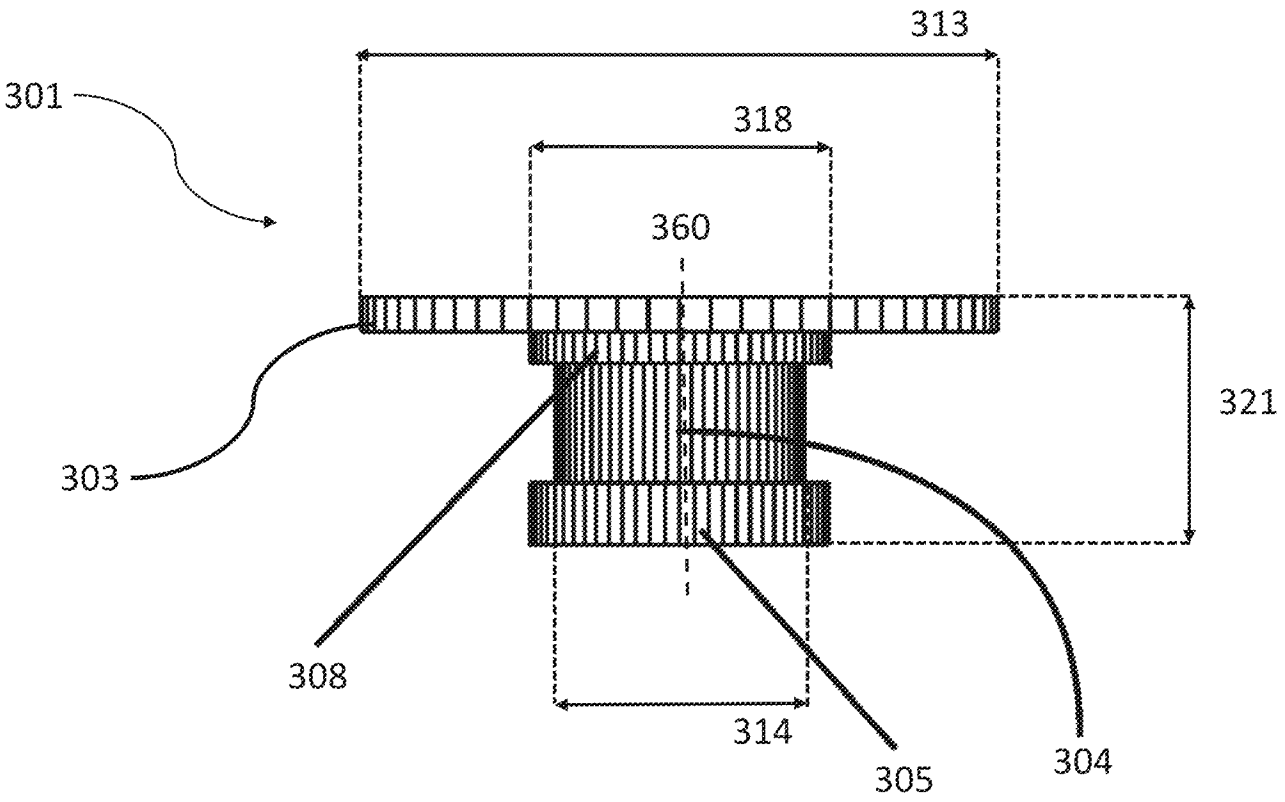
FIG. 5 is an illustration of a side view of a strap button of the first embodiment.
Figure 6:
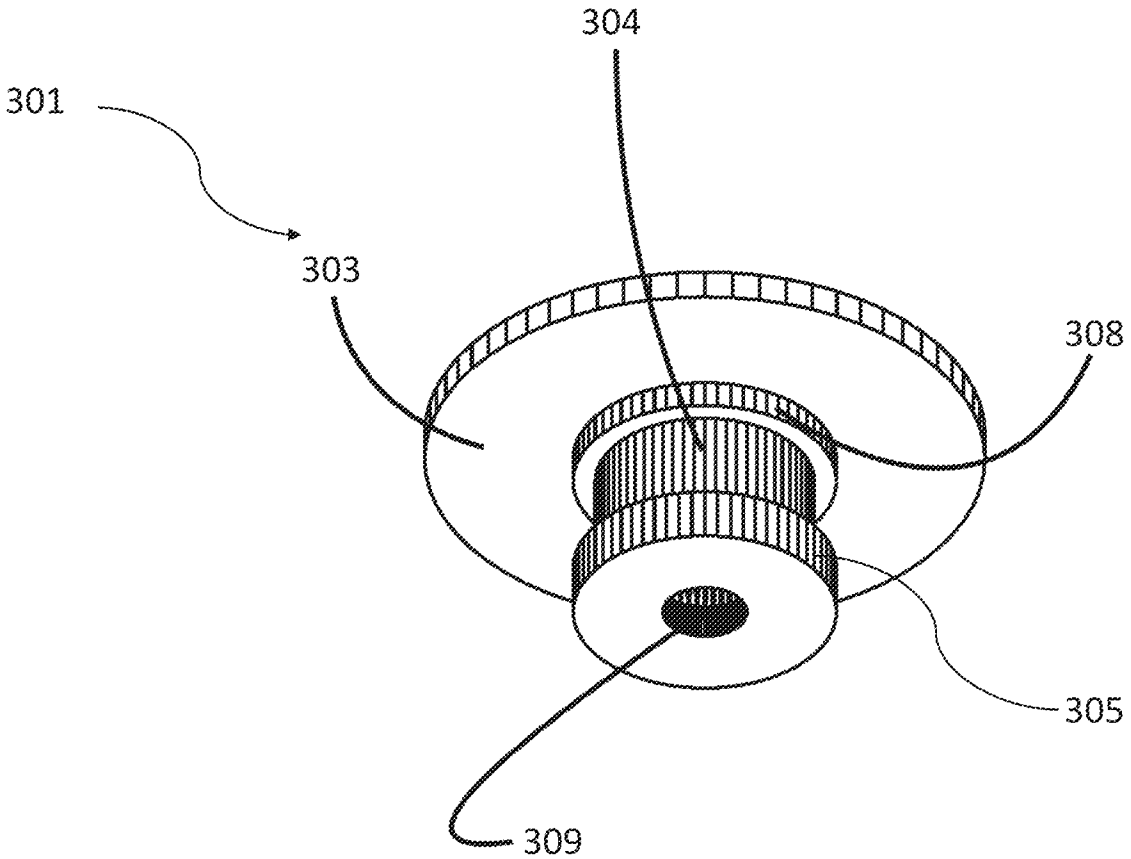
FIG. 6 is an illustration of an isometric bottom view of a strap button of the first embodiment.
Figure 7:
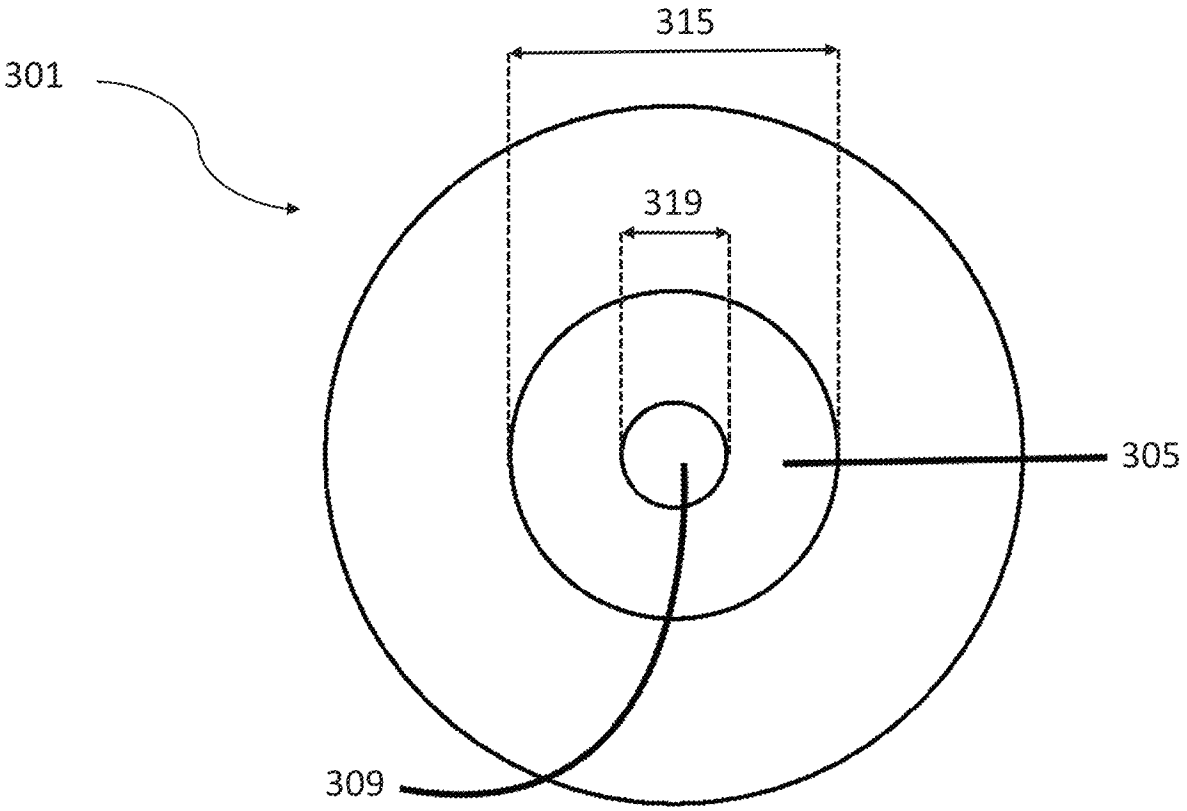
FIG. 7 is an illustration of a bottom view of a strap button of the first embodiment.
Figure 8:
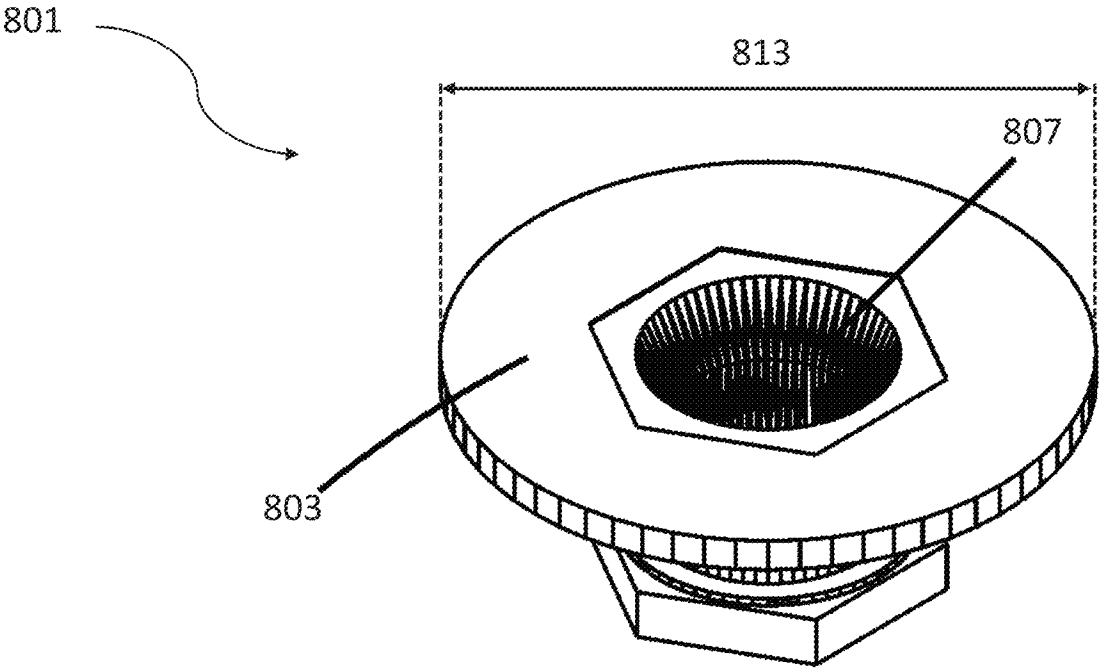
FIG. 8 is an illustration of an isometric top view of a strap button with a flange and a hexagon-base according to a second embodiment.
Figure 9:
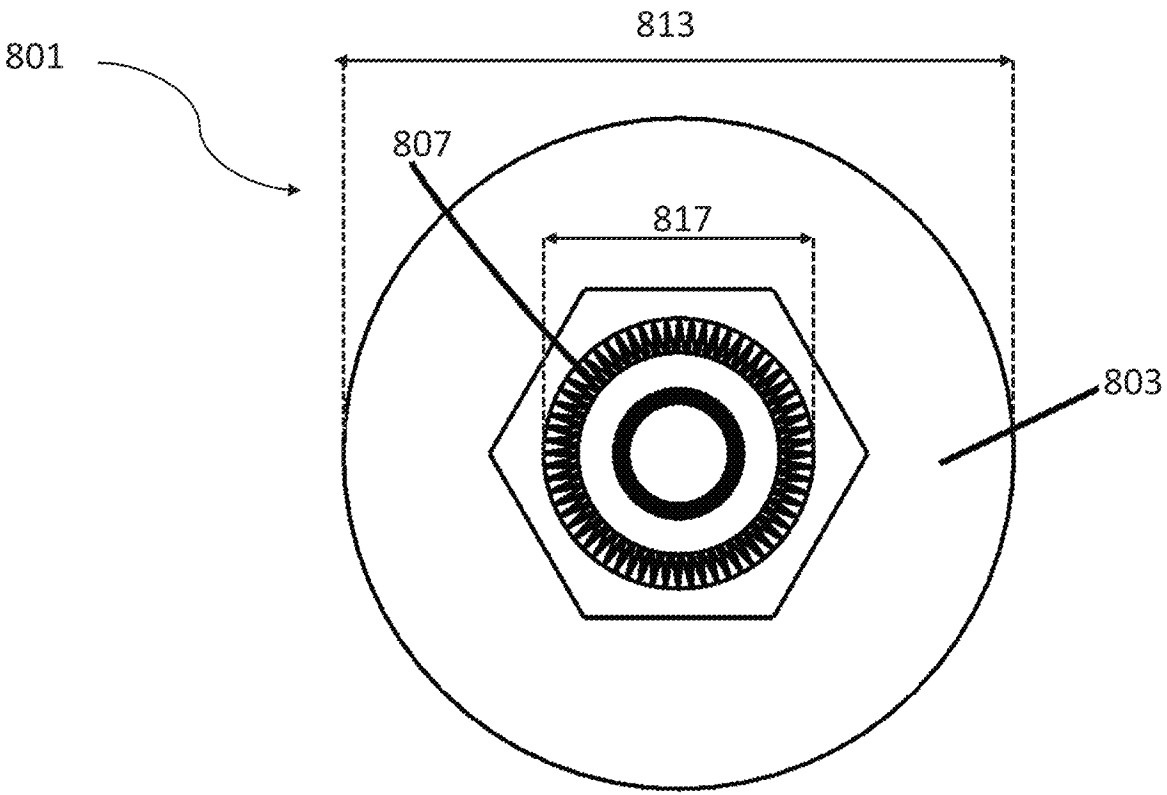
FIG. 9 is an illustration of a top view of a strap button of the second embodiment.

As shown in FIGS. 3-7, each of outer flange 303, lug 304, inner lug 307, retaining flange 308, inner flange 305, and bore 309 have respective diameters. In certain embodiments, the diameters are defined with respect to the axis 360 of the strap button 301. As shown in FIG. 5, an axis 360 of the strap button 301 that coincides with a line passing through the approximate center points of the opposite ends of the lug 304 and extending along the length of the lug. The inner flange 305 is toward a proximal end of the axis 360 and the outer flange 303 is toward a distal end of the axis. In certain embodiments, outer flange 303 has an outer flange diameter 313 (defined in certain embodiments as a diameter or a maximum width in a direction perpendicular to the axis 360) in the range from 22 mm to 44 mm, 25 mm to 40 mm, 30 mm to 35 mm, or combinations thereof. In certain embodiments, lug 304 has a lug diameter 314 (defined in certain embodiments as a diameter or a maximum width in a direction perpendicular to the axis 360) in the range from 8 mm to 18 mm, 10 mm to 16 mm, or 12 mm to 14 mm. In certain embodiments, inner lug 307 has an inner lug diameter 317 (defined in certain embodiments as a diameter or a maximum width in a direction perpendicular to the axis 360) in the range from 5 mm to 14 mm, 7 mm to 12 mm, or 9 mm to 11 mm. In certain embodiments, retaining flange 308 has a retaining flange diameter 318 (defined in certain embodiments as a diameter or a maximum width in a direction perpendicular to the axis 360) in the range from 8 mm to 22 mm, 10 mm to 20 mm, or 12 mm to 18 mm. In certain embodiments, inner flange 305 has an inner flange diameter 315 (defined in certain embodiments as a diameter or a maximum width in a direction perpendicular to the axis 360) in the range from 8 mm to 22 mm, 10 mm to 20 mm, or 12 mm to 18 mm. In certain embodiments, bore 309 has a bore diameter 319 (defined in certain embodiments as a diameter or a maximum width in a direction perpendicular to the axis 360) in the range from 3 mm to 6 mm. In addition, strap button 301 has height 321 (defined in certain embodiments as a length along the axis 360) in the range from 4 mm to 22 mm, or 8 mm to 18 mm, or 12 mm to 14 mm, as shown in FIG. 5.

In certain embodiments, the geometry of the strap button 301 is selected to prevent a strap 200 from becoming dislodged from the strap button 301. This can be performed, for example, by selecting the ratio between the outer flange diameter 313 to one or more of the lug diameter 314, the inner flange diameter 315, and the retaining flange diameter 318. For example, in some embodiments, the inner flange diameter 315 is 18%-50% of the outer flange diameter 313 (in some embodiments the lower bound of the range is 18%, 20%, 25%, 30%, or 35%, and in some embodiments the upper bound of the range is 50%, 45%, 40%, or 35%), or is 35%-55%, 40%-50%, or 40%-51% smaller than the outer flange diameter 313. In certain embodiments, the lug diameter 314 is 18%-42% of the outer flange diameter 313 (in some embodiments the lower bound of the range is 18%, 20%, 22%, 26%, or 30%, and in some embodiments the upper bound of the range is 42%, 38%, 34%, or 30%), or 35%-46%, 40%-43%, or 40% smaller than the outer flange diameter 313. In certain embodiments, the retaining flange diameter 318 is 18%-50% of the outer flange diameter 313 (in some embodiments the lower bound of the range is 18%, 20%, 25%, 30%, or 35%, and in some embodiments the upper bound of the range is 50%, 45%, 40%, or 35%), or 35%-55%, 40%-50%, or 40%-51% smaller than the outer flange diameter 313. In certain embodiments, the lug diameter 314 is 36%-99% of the retaining flange diameter 318 (in some embodiments the lower bound of the range is 36%, 40%, 50%, 60%, or 70%, and in some embodiments the upper bound of the range is 99%, 90%, 80%, or 70%), or 1%-19%, 1%-20%, 1%-22%, or 10%-20% smaller than the retaining flange diameter 318. In certain embodiments, the height 321 is 9%-50% of the outer flange diameter 313 (in some embodiments the lower bound of the range is 9%, 15%, 20%, 25%, or 30%, and in some embodiments the upper bound of the range is 50%, 45%, 40%, or 30%), or 18%-50%, 32%-45%, or 40% smaller than the outer flange diameter 313. In certain embodiments, where the outer flange 303, lug 304, inner flange 305, and/or retaining flange 308 are non-circular, the values and ratios of diameters 313, 314, 315, and/or 318 apply to the largest widths of the non-circular dimension in a direction perpendicular to the direction of the axis 360 of the strap button 301. Exemplary non-circular embodiments are described in further detail, below. The lug diameter 314 is 3-4 mm larger than the inner lug diameter 317 in order to account for the wall thickness of the lug integral to the strap button's structure, strength, and ease of manufacture. The inner lug diameter 317 is 27%-78% of the lug diameter 314 (in some embodiments the lower bound of the range is 27%, 35%, 40%, 45%, or 50%, and in some embodiments the upper bound of the range is 78%, 70%, 60%, or 50%).

According to certain embodiments, when the ratio of the outer flange diameter 313 to one or more of the lug diameter 314, the inner flange diameter 315, and the retaining flange diameter 318 is made larger, the strap button 301 will provide more security against strap 200 becoming dislodged because it is more difficult for the hole 202 to slip over the outer flange 303. In addition, it is undesirable to make the outer flange diameter 313 too large so as to prevent a strap 200 from being attached to the strap button 301, according to certain embodiments. Therefore, in these embodiments, the outer flange diameter 313 should not exceed 44 mm, and/or the lug diameter 314, retaining flange diameter 318, and inner flange diameter 315 are at a minimum 18% of the outer flange diameter 313.

As illustrated in FIGS. 20-21, in certain embodiments, the strap button 301 is attached to an instrument by making a hole into the instrument's body 2020 (for example, by drilling), and then passing a screw 2012 through the strap button's bore 309 (FIG. 21) and into the hole in the instrument's body 2020. This screw is tightened and fastens the strap buttons 301 to the instrument's body 2020 to stably hold the strap buttons 301 in place. This permits the strap 200 to securely hold the instrument via strap buttons 301. In certain embodiments, the strap button can also be attached via adhesive, a bolt, magnets, or other means suitable for the weight and size of the instrument. In certain embodiments, a rubber or felt washer is placed between strap button 301 and the instrument's body 2020 to minimize any damage to the instrument's finish.

Figure 10:
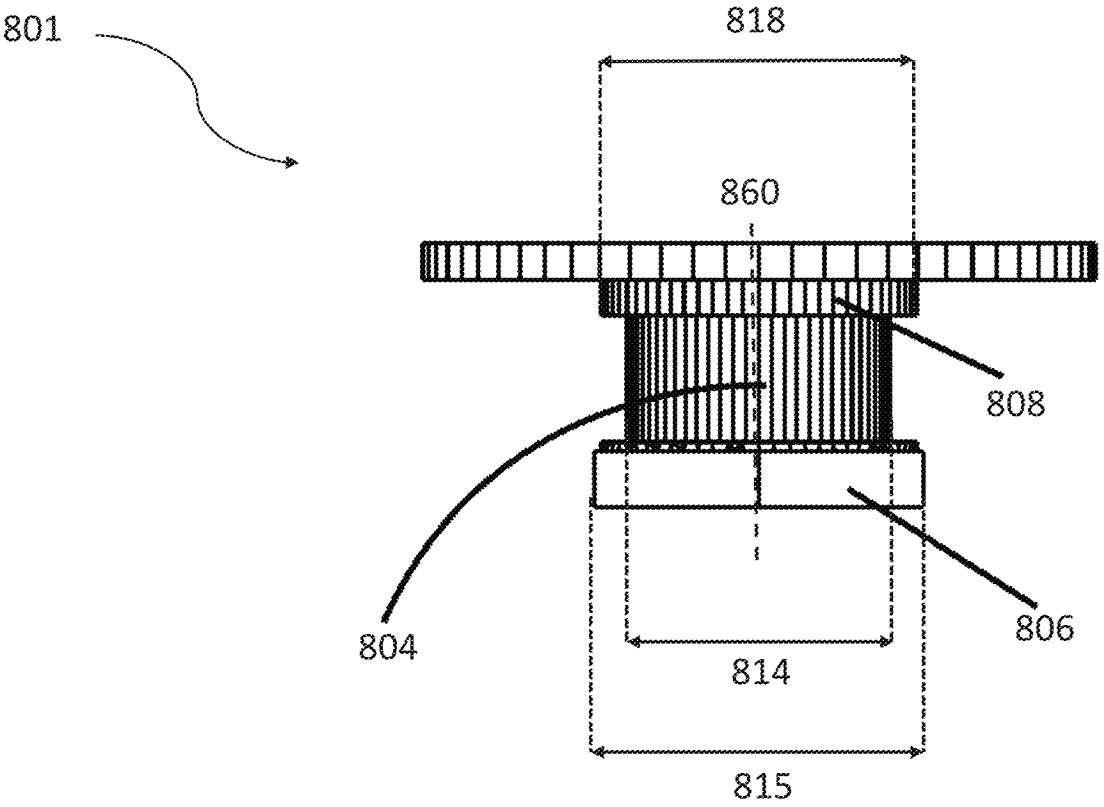
FIG. 10 is an illustration of a 'x' side view of a strap button of the second embodiment.
Figure 11:
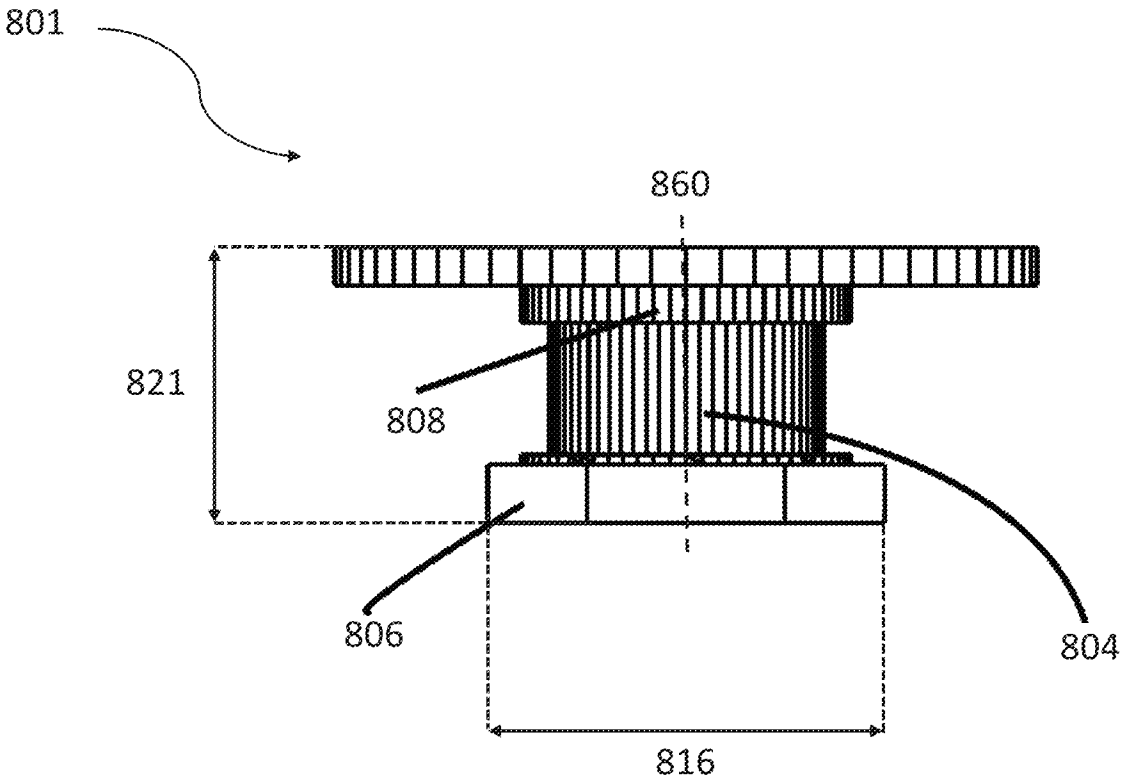
FIG. 11 is an illustration of a 'y' side view of a strap button of the second embodiment.
Figure 12:
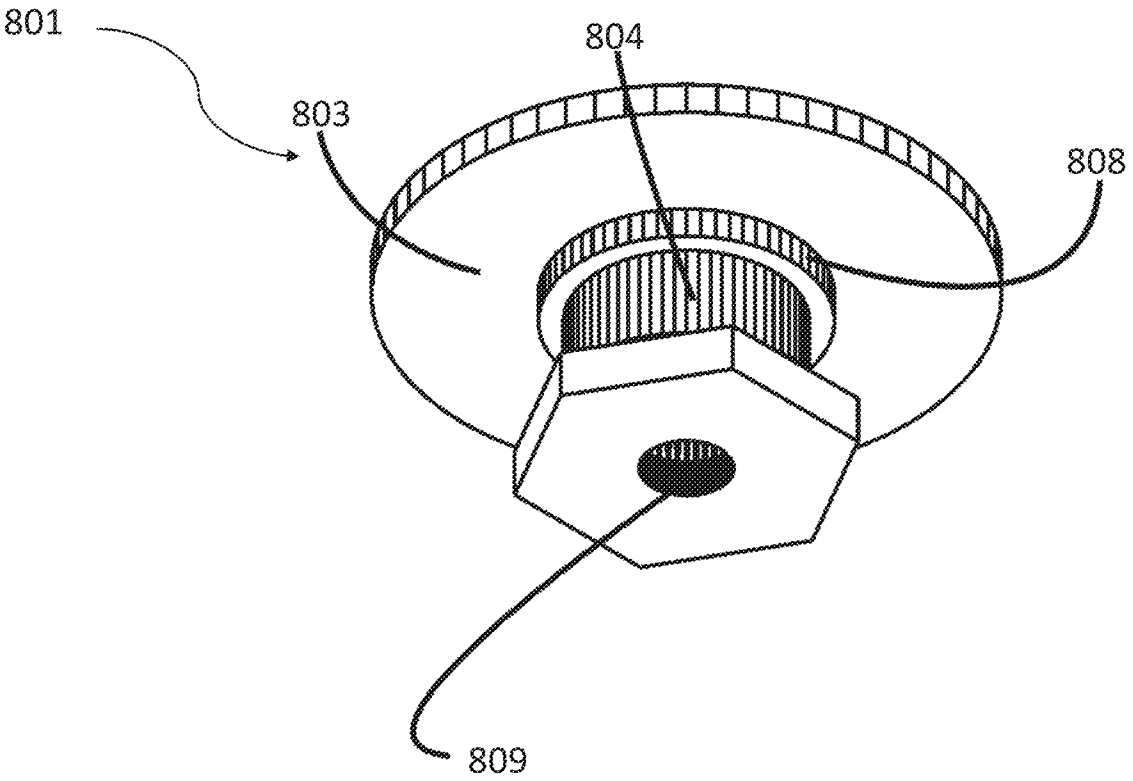
FIG. 12 is an illustration of an isometric bottom view of a strap button of the second embodiment.
Figure 13:
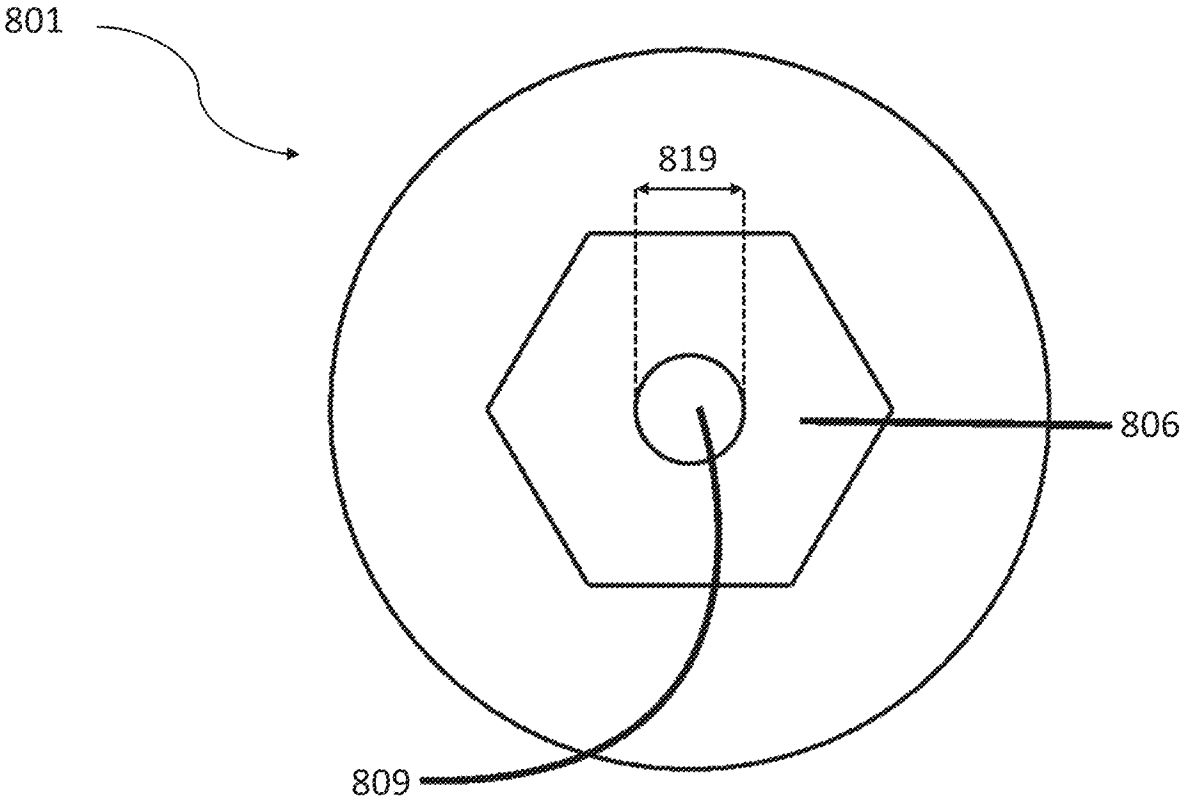
FIG. 13 is an illustration of a bottom view of a strap button of the second embodiment.

FIGS. 8-13 illustrate a strap button 801 according to a second embodiment. For convenience, like numbers in FIGS. 8-13 describe like parts as in FIGS. 3-7. For example, in certain embodiments, outer flange 803 is similar or identical to outer flange 303 described above. The second embodiment is different from the first embodiment because the inner flange 806 is hexagonal shaped, rather than circular shaped. Hexagonal inner flange 806 has a width 815 defined between opposite sides, and a width 816 defined between opposing corners, both perpendicular to an axis 860 of the strap button 801, as shown in FIGS. 10-11. In certain embodiments, the widths 815 or 816 of the hexagonal inner flange 806 are 29%-65% of the outer flange diameter 813 (or other widths, discussed above with respect to non-hexagonal embodiments). In certain embodiments, the hexagonal inner flange 806 allows the user to conveniently adjust or dismount the strap button 801 with a hex wrench, such as a ¼" hex wrench. In certain embodiments, the inner flange 806 can be other cross sections, such as a triangle, quadrilateral polygon, pentagon, other various polygons, various stars, and other shapes. Similarly, like the inner flange 806, one or more of the outer flange 803, the lug 804, and the retaining flange 808 can have a non-circular cross section. In such non-circular embodiments, the dimensions are defined by widths rather than diameter, as discussed above. Similar to the first embodiment, the geometry, including diameters, widths, and shapes of parts of the strap button 801 can be adjusted to reduce the ability of a strap 200 to become dislodged from the strap button 801.

FIGS. 14-19 illustrate ornaments on a strap button 1401 according to certain embodiments. In certain embodiments, ornamentations are inlayed, indented, fully cut-out, laser-engraved, and/or decorated by various other manufacturing processes onto the strap button. In certain embodiments, the ornamentations are on the outside surface 1423 of the outer flange 1403. The embodiments of FIGS. 14-19 can be combined with any of the preceding embodiments. Elements of the strap button 301 and 801 previously described are omitted in the discussion of strap button 1401 for concision. Ornamentations provide the user a way to further personalize and differentiate instruments.

Figure 14:
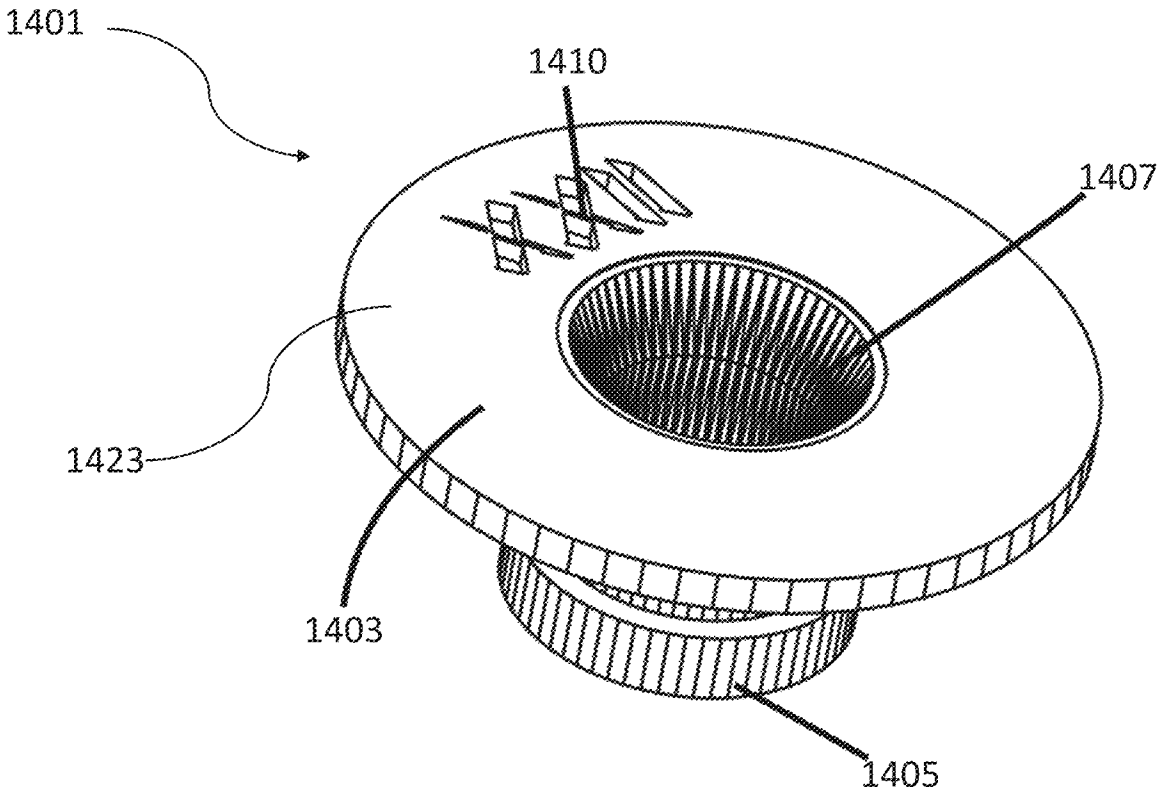
FIG. 14 illustrates an isometric top view of an ornamented strap button according to certain embodiments.
Figure 15:
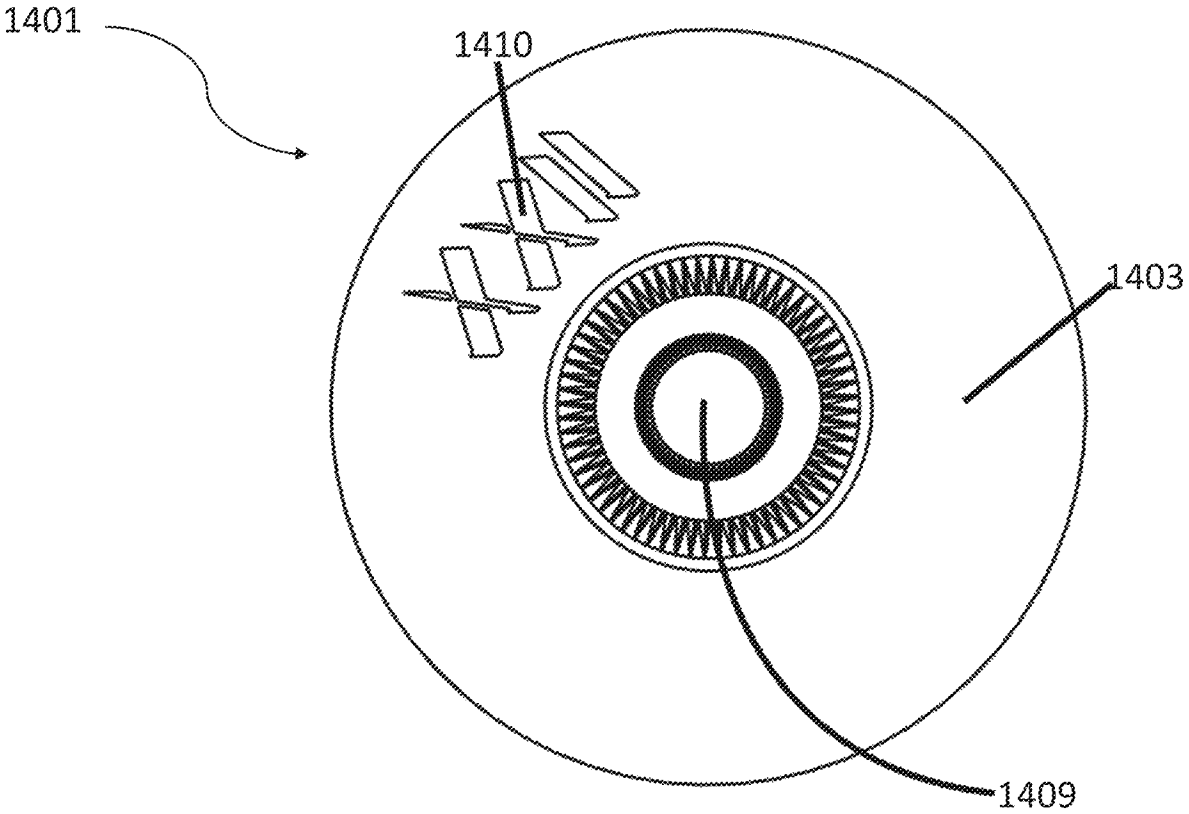
FIG. 15 illustrates a top view of an ornamented strap button according to the embodiment of FIG. 14.

FIGS. 14-15 illustrate a semi-cut roman numeral ornamentation 1410 on the outer flange 1403. The ornamentation 1410 is indented, inlayed, or semi-cut 1410 into the outside surface 1423 of the outer flange 1403 such that it does not extend entirely through outer flange 1403 to the side of the outer flange facing the inner flange 1405.

Figure 16:
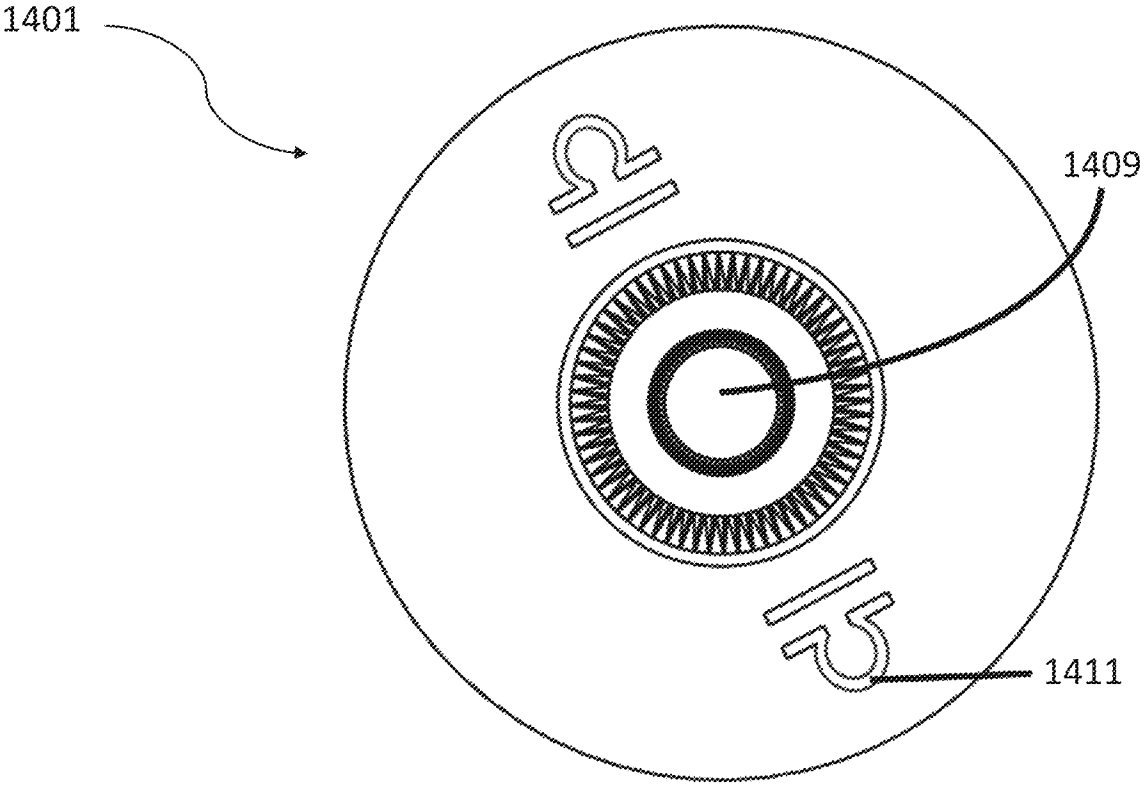
FIG. 16 illustrates a top view of an ornamented strap button according to certain embodiments.
Figure 17:
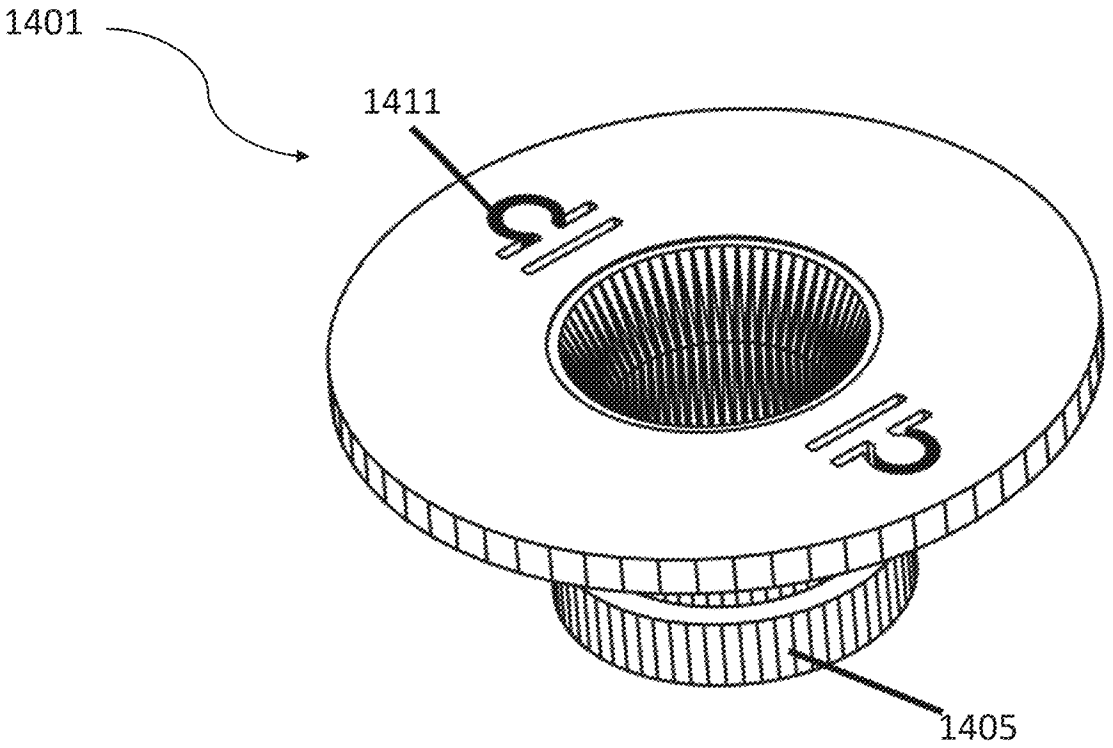
FIG. 17 illustrates an isometric top view of an ornamented strap button according to the embodiment of FIG. 16.

FIGS. 16-17 illustrate a full-cut zodiacal ornamentation 1411. Ornamentation 1411 is fully removed from the outer flange 1403 so that it extends from one surface of the outer flange 1403 to the other surface.

Figure 18:
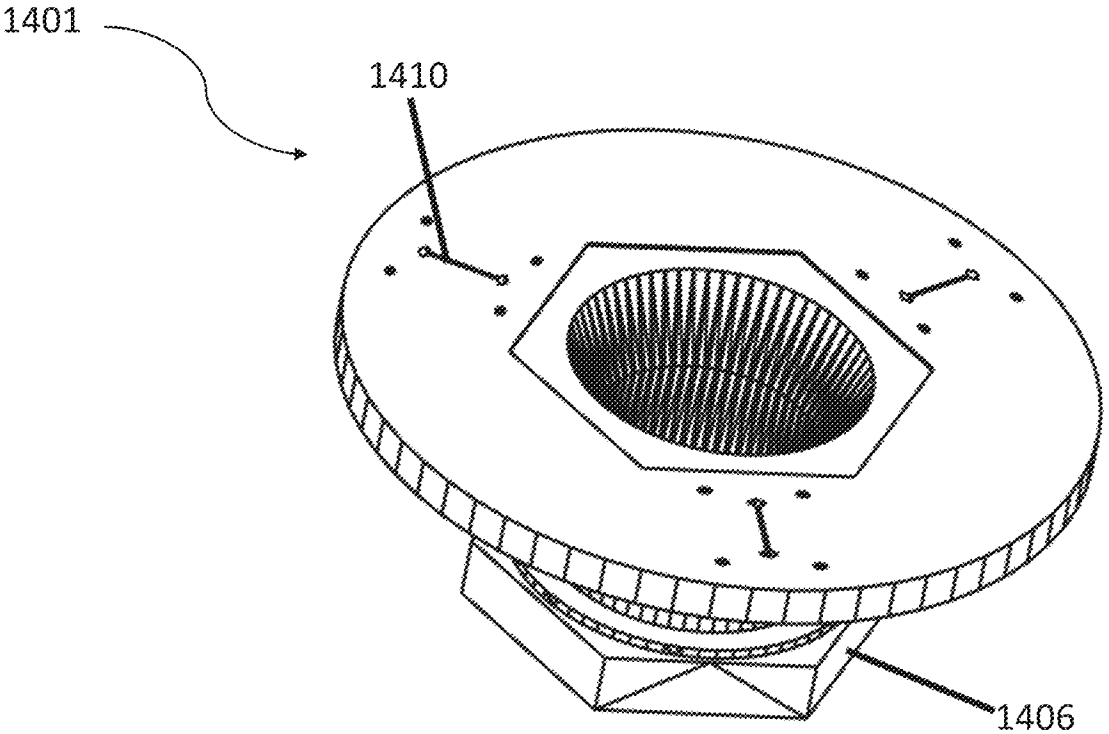
FIG. 18 illustrates an isometric top view of an ornamented strap button, hexagon-base according to certain embodiments.
Figure 19:
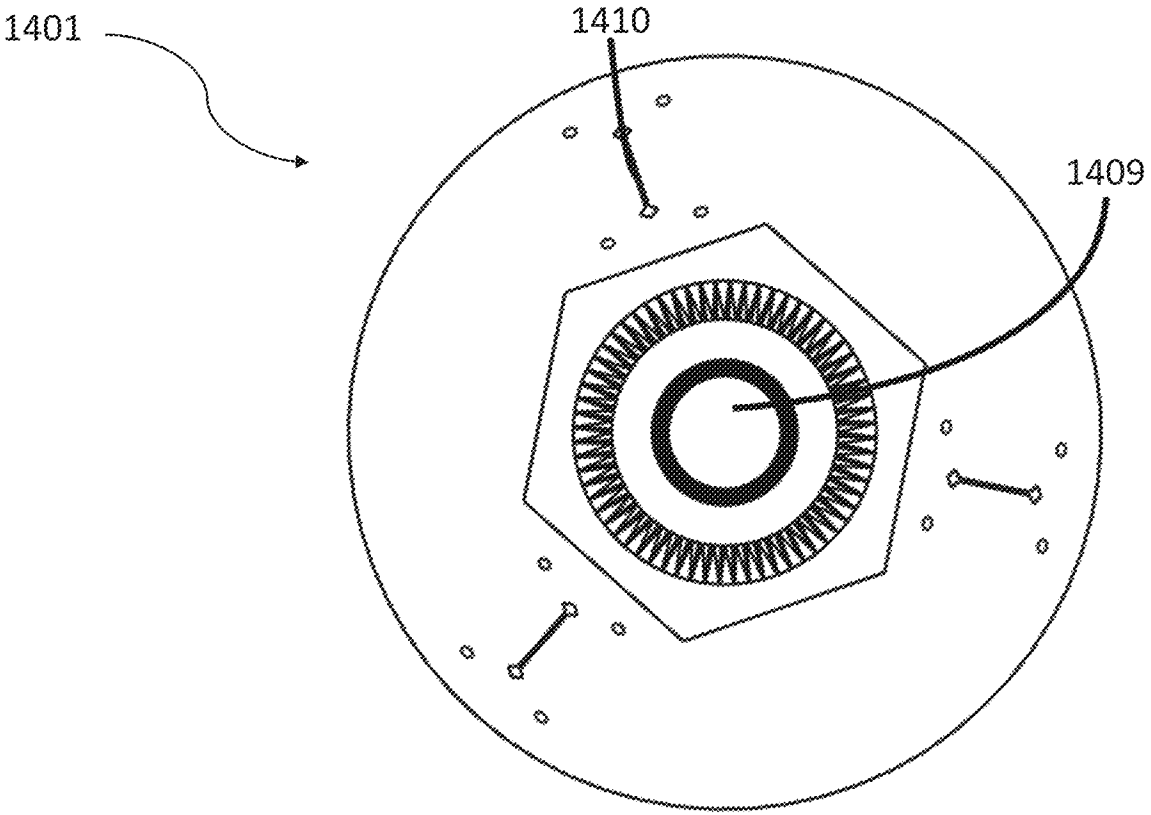
FIG. 19 demonstrates a top view of an ornamented strap button, hexagon-base embodiment according to the embodiment of FIG. 18.

FIGS. 18-19 illustrate an embodiment of the present invention incorporating a mechanical semi-cut ornamentation 1410 while also employing a hexagonal base 1406. It should be understood that any parts of the present invention may take on a variety of decorative forms, but also need not include any ornamentation at all. Additional ornamental designs include words, zodiac symbols, astrological symbols, numbers, roman numerals, astronomical symbols, constellations, planet symbols, tarot card suits, playing card suits, chess pieces, I-Ching symbols, runes, skulls, drawings, illustrations, logos, graphics, weather symbols, plants, elemental symbols, initials, animals, mythical creatures, mythological symbols, sigils, musical symbols, dinosaurs, vehicles, traffic symbols, chemical symbols, metals, and other various symbols. The strap buttons discussed above may be fabricated by a variety of manufacturing techniques, such as press forming, molding, additive manufacturing (also known as "3D printing"), lathe, computer numerical control (CNC), or other methods. As discussed above, in certain embodiments, the strap button is integrally formed to simplify manufacture and use.

As discussed above, FIG. 22 is a side view of how strap 200 is secured to strap button 301, according to certain embodiments. The lug 304 passes through strap hole 202. The outer flange 303 and the instrument's body 2020 prevent strap 200 from dislodging from the lug 304 or the strap button 301. In certain embodiments, the retaining flange 308 also acts to prevent the strap from dislodging from lug 304 or the strap button 301. The retaining flange 308 can also add mechanical strength to the strap button 301, for example, by decreasing the likelihood that the outer flange 303 will bend, separate, or otherwise break or become damaged. In certain embodiments, the retaining flange 308 is step-shaped, as shown herein, but in other embodiments, the retaining flange 308 may have a curved or contoured cross section. In certain embodiments, the inner flange 305 helps prevent damage to the instrument as discussed above. In certain embodiments, the retaining flange 308 and inner flange 305 cooperate to maintain the strap 200 on the lug 304 therebetween. In certain embodiments, this cooperation provides an initial or first barrier to retaining the strap 200 on the lug 304 or strap button 301. The outer flange 303 and instrument body 2020 further cooperate to maintain strap 200 on the lug 304 therebetween. In certain embodiments, this cooperation provides an additional or second barrier to retaining the strap 200 on the lug 304 or strap button 301. According to certain embodiments, the first and second cooperation provides a substantially U-shaped cross section, such as shown in FIG. 22, to provide a gradated structure to urge the strap 200 into retention or position on the lug 304 and to prevent the strap 200 from slipping off or from damaging the guitar. In certain embodiments, auxiliary flanges are used between the retaining flange 308 and the lug 304, as well as between inner flange 305 and lug 304. The auxiliary flanges keep the supporting strap 200 further secured to the lug 304, and provide subsequent or additional barriers to prevent the strap 200 from dislodging from strap button 301.

The invention claimed is:

1. A strap button comprising:

an inner flange having a contact surface configured to directly or indirectly contact the instrument;

a lug extending from the inner flange in a direction opposite the contact surface of the inner flange, the lug defining an axis of the strap button along the direction opposite the contact surface with the inner flange toward a proximal end of the axis of the strap button, the lug having a lug width defined by a largest width of the lug in the direction perpendicular to the axis of the strap button, the inner flange having an inner flange width defined by a largest width of the inner flange in the direction perpendicular to the axis of the strap button;

an outer flange toward a distal end of the axis of the strap button, the outer flange having an outer flange width defined by a largest width of the outer flange in a direction perpendicular to the axis of the strap button; and a retaining flange adjacent the outer flange along the axis of the strap button toward the inner flange, the retaining flange having a retaining flange width defined by a largest width of the retaining flange in a direction perpendicular to the axis of the strap button, wherein the lug width is smaller than the inner flange width, the retaining flange width, and the outer flange width, wherein the retaining flange width is 18%-50% of the outer flange width and the inner flange width is 18%-50% of the outer flange width, and wherein the lug is configured to support a hole of a supporting strap between the outer flange and the instrument.

2. The strap button of claim 1, wherein the retaining flange is configured as a barrier to the supporting strap from slipping off the lug.

3. The strap button of claim 1, wherein the retaining flange and the outer flange are configured as a first barrier and a second barrier, respectively, to the supporting strap from slipping off the lug.

4. The strap button of claim 1, wherein the lug width is 36%-99% of the retaining flange width.

5. The strap button of claim 1, wherein the retaining flange width is between 8-22 mm.

6. The strap button of claim 1, wherein at least one of the inner flange, the outer flange, the retaining flange, or the lug has a circular cross section along the axis of the strap button.

7. The strap button of claim 1, wherein at least one of the inner flange, the outer flange, the retaining flange, or the lug has a hexagonal cross section along the axis of the strap button.

8. The strap button of claim 1, wherein at least one of the inner flange, the outer flange, the retaining flange, or the lug has a rectangular cross section along the axis of the strap button.

9. The strap button of claim 1, wherein the inner flange, the outer flange, the lug and the retaining flange are integrally formed.

10. The strap button of claim 1, wherein the outer flange and the retaining flange are integrally formed.

11. The strap button of claim 1, wherein the retaining flange is configured to add mechanical strength to the strap button.

12. The strap button of claim 1, the strap button having a strap button height defined as a length of the strap button along the axis of the strap button, wherein the strap button height is between 4-22 mm.

13. The strap button of claim 12, wherein the strap button height is 9%-50% of the outer flange width.

14. The strap button of claim 1, wherein the lug comprises an inner lug that is defined as an interior surface of the lug extending in a direction along the axis, the inner lug having an inner lug width defined by a largest width of the inner lug in the direction perpendicular to the axis of the strap button, wherein the lug width is between 3 mm and 4 mm larger than the inner lug width.

15. The strap button of claim 14, wherein the inner lug width is 27%-78% of the lug width.

16. The strap button of claim 1, the strap button further comprising one or more auxiliary flanges between the outer flange and the retaining flange along the axis of the strap button, wherein the one or more auxiliary flanges are configured as a barrier to the supporting strap from slipping off the lug.

* * * * *